US008646372B1

(12) United States Patent
Lee

(10) Patent No.: US 8,646,372 B1
(45) Date of Patent: Feb. 11, 2014

(54) PORTABLE AND FOLDABLE SHIELDING DEVICE

(71) Applicant: Jen-Feng Lee, Hacienda Heights, CA (US)

(72) Inventor: Jen-Feng Lee, Hacienda Heights, CA (US)

( * ) Notice: Subject to any disclaimer, the term of this patent is extended or adjusted under 35 U.S.C. 154(b) by 0 days.

(21) Appl. No.: 13/747,288

(22) Filed: Jan. 22, 2013

(51) Int. Cl.
*F41H 7/00* (2006.01)

(52) U.S. Cl.
USPC ..... 89/36.07; 89/36.09

(58) Field of Classification Search
USPC ..... 89/36.07, 36.09, 36.03, 36.02
See application file for complete search history.

(56) References Cited

U.S. PATENT DOCUMENTS

| | | | | |
|---|---|---|---|---|
| 6,581,505 | B1 * | 6/2003 | Levell | 89/36.07 |
| 7,520,206 | B2 * | 4/2009 | Baker | 89/36.06 |
| 7,980,166 | B1 * | 7/2011 | Fuqua et al. | 89/36.07 |
| 8,464,493 | B2 * | 6/2013 | Boone et al. | 52/646 |
| 2009/0235814 | A1 * | 9/2009 | Cashin et al. | 89/36.02 |
| 2012/0186435 | A1 * | 7/2012 | Garcia | 89/36.07 |

* cited by examiner

*Primary Examiner* — J. Woodrow Eldred
(74) *Attorney, Agent, or Firm* — Jen-Feng Lee

(57) ABSTRACT

Present invention teaches a foldable multi-pane shielding device consisting of a number of connected rigid planar pieces that can be easily deployed when set up in a corner of a room or a classroom; a pivoting latch box will provide the central bow-like tensioning force to a central module of a plurality of rigid planar pieces, when turned to a horizontal orientation, and some inside bow pieces can be drawn out from the latch box and further providing overall bow-like tensioning force to the deployed structure, forming a temporary safety zone against incoming projectiles, such as bullets.

28 Claims, 17 Drawing Sheets

PORTABLE AND FOLDABLE SHIELDING DEVICE

The present application is a continuation-in-part (CIP) application to a co-pending application, and claimed the priority of the disclosure therein, Ser. No. 13/743,234, filed by the same inventor, having filing date of Jan. 16, 2013.

FIELD AND BACKGROUND OF THE INVENTION

The present invention relates generally to a foldable and easy-to-deploy shielding device, for creating a temporary protecting shield or screen, during emergency situations.

Particularly, present invention provides for an easily collapsed/folded and easily extended/deployed shielding device that takes up little space when put away and can create a substantial shielded "pie" area for temporary protection and resistance against incoming projectiles or bullets, benefitting some fifteen adults or twenty-five school children of normal size.

When the shielding device of present application is folded, it is likely to look like a normal travel suit case and can be easily stored under tables, beds, or set to "stand next to" a wall, without affecting people's normal activities. As such, the folded device can be placed out of the way and not affecting people's regular day-to-day activities.

From the folded/collapsed state, the shielding device of present application can be deployed quickly, in response to an unexpected emergency situation, such as one where a random attack or shooting takes place, having the rigid planar pieces set up to be a standing screen, with some horizontal piece(s) providing a bow-like tensioning force to the rigid planar pieces that are expected to be the deflecting surface of oncoming projectiles.

OBJECTS AND SUMMARY OF THE INVENTION

Present invention teaches to build an easy-to-use and easy-to-store, foldable projectile-resisting shield that can be deployed within seconds, to provide for emergency protection from dangerous objects such as bullets discharged from guns, or similar weapons.

The invention disclosed herein comprises of a plurality of rigid planar pieces serially connected together. As such, when the rigid planar pieces are folded up for storing away, the shield looks a like a travel suit case and is easy to handle or kept/store away.

At deployed state, the shield looks like a multiple-pane screen and is generally self-standing, with hooking devices on right and left sides for engaging to adjacent structures, such as walls.

With a pivoting latch box that can be turned from an upright position to a horizontal position, and with inner bow piece(s) that can be drawn out, there is a bow-like tensioning force to support the multiple-pane screen structure to withstand oncoming impact force, such as bullets or other dangerous projectiles.

The rigid planar pieces can be made of metal, hard plastic, or other composite materials suitable for the projectile-resisting purpose or bullet-resisting purpose. The commercially available Kevlar material, or other new and to-be-developed materials can all be used to construct the shield of present invention.

Optionally, the rigid planar piece can be made from a rigid frame having a central "cavity" area that is filled by appropriate fabric-like material, which can also be made from similar Kevlar or other suitable composite materials.

With the layer(s) of said sturdy fabric-like material fixed to the rigid frame, there is an inherent "wiggle" effect, when a projectile hits, similar to a golf ball hitting a net or a cloth hanging in mid-air, and is conducive to reducing the impact power produced by a fast-traveling projectile.

Depending on the desired implementation, one or more layers of said sturdy flexible fabric-materials may be fixed to said rigid frame, for better protective.

For the latch box and the inner bow piece, some limited bendability may be desired to form the combined bow-like tensioning structure at deployed state.

In a sample 7-piece construction, as further discussed in later paragraphs, each rigid planar piece may have a sample 2-D size of about 2-foot by 5-foot. As such, said sample 7-piece shield will have a 14-foot long and 5-foot high protective "wall", when deployed.

If the shield of present invention, of the sample size stated herein, is deployed in a room corner, having 90-degree walls flanking on two sides, the "pie" area created by the 14-foot shield will have a radius of roughly 9 feet, and an area of roughly 64 square feet. This "pie" area will be generally sufficient for some 25 school children or 15 people of normal size to stay down close together (under the proposed 5-foot shield wall) for a short while during an emergency.

The actual dimensions or sizes of these rigid planar pieces are not limited by the 2 by 5 disclosed herein. Other sizes can certainly be chosen for implementation.

DESCRIPTION OF THE DRAWINGS

The accompanying drawings, which are incorporated in and constitute a part of this specification, illustrate the preferred embodiments of the invention and together with the description, serve to explain the principles of the invention.

A brief description of the drawings is as follows.

DETAILED DESCRIPTION OF THE PREFERRED EMBODIMENT

As shown herein, the preferred embodiment of present invention includes a projectile-resisting shielding device 10 that is generally formed by a plurality of connected rigid planar pieces 100.

The connection between any two adjacent rigid planar pieces 100 may be made by hinges 190. This type of hinged connection requires no disclosure herein.

The shielding device 10 can be easily folded up into a "travel case" type configuration, making it easy for storing away, or for keeping to the sidewall of a housing structure, such as a classroom wall. The shielding device 10 can be easily unfolded for deployment into a standing multiple-pane "screen" structure, due to the combined surfaces of the serially-connected rigid planar pieces 100.

Figure 1A:
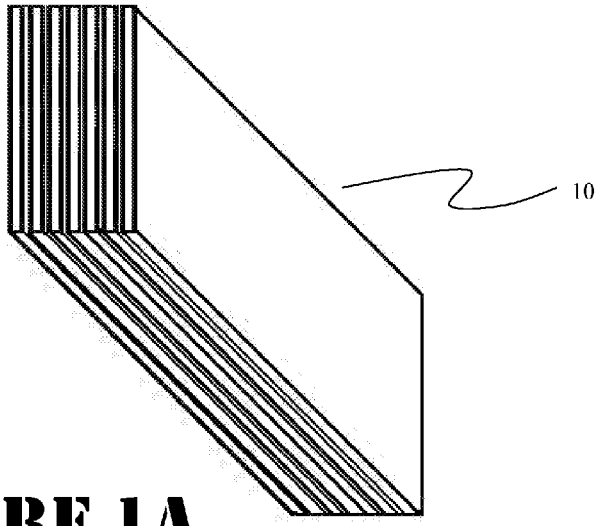
FIG. 1A shows the folded up state of the shielding device of present application; the folded up multi-pane structure looks like a travel case.
Figure 1B:
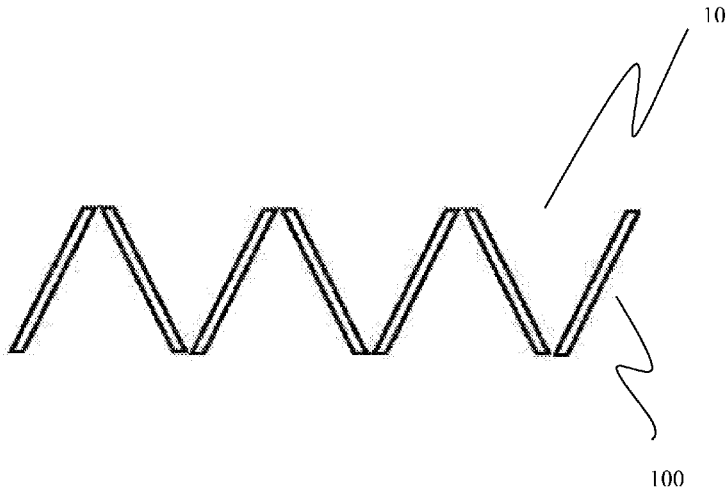
FIG. 1B shows the top-down view for the half-extended state of the shielding device comprised of the rigid planar pieces.
Figure 1C:
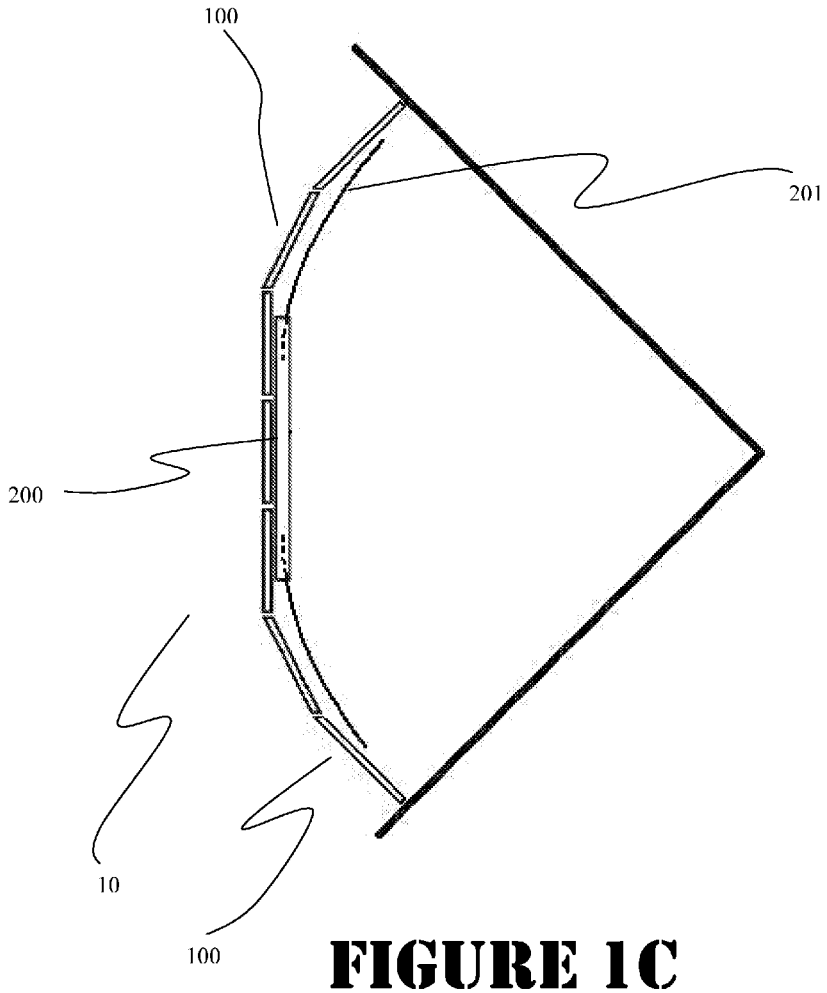
FIG. 1C shows the top-down view for the deployed stated of the shielding device

FIGS. 1A, 1B and 1C show the shielding device 10 in fold-up state, half-extended state and fully deployed state.

The shielding device 10 can have either odd-number or even-number pieces of said rigid planar pieces 100. The disclosure herein first focused on odd-number pieces, total of seven (7) pieces, as shown in FIGS. 1A-1C for example. But a shielding device 10 of any plurality number of rigid planar pieces 100 can follow the teachings herein to practice the invention claimed, as long as the number is suitable for the intended size of the "pie" area created.

By way of example, and not intended for limiting the number of rigid planar pieces 100, the following disclosure consists of 7 rigid planar pieces 100.

Figure 2:
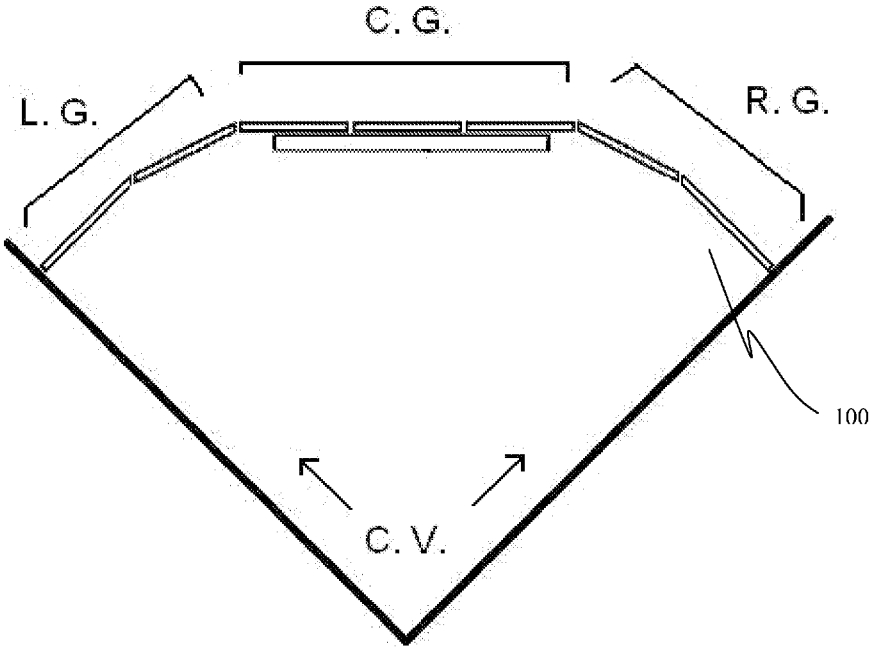
FIG. 2 is the bird's eye view of the left/central/right "groups" of rigid planar pieces, in the deployed state (the inner bow piece did not get drawn out, as opposed to drawn out view in FIG. 1C).

For ease of reference, this exemplary 7-piece construction will be divided into 3 groups: a central group CG consisting of 3 rigid planar pieces 100, a right group RG having 2 rigid planar pieces 100 and a left group LG having 2 rigid planar pieces 100. This distinction of left/center/right is made from a corner view CV point, such as the corner of two walls inside a room, looking toward a deployed shield 10, as shown in FIG. 2.

Figure 3A:
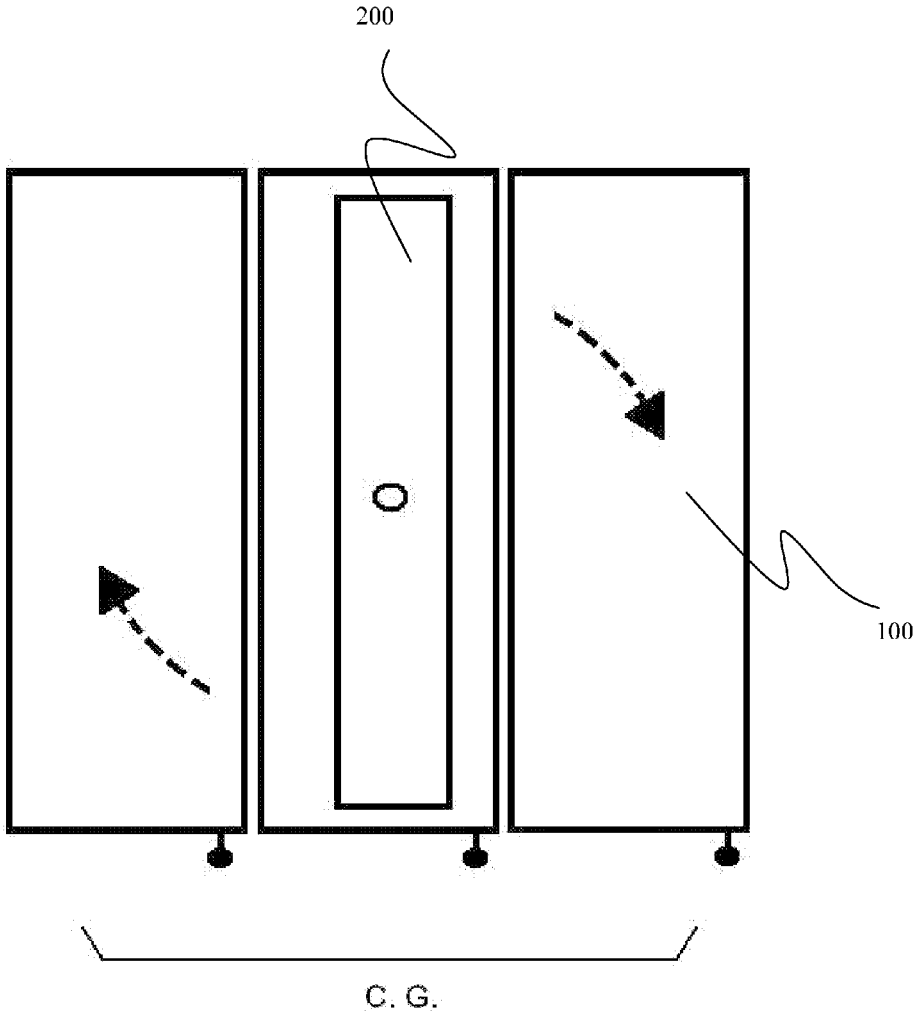
FIG. 3A shows the latch box in an upright position, as attached to a central group.

A latch box 200 is connected to the center rigid planar piece 100 of the central group CG. The connection is made at a central pivoting point 150, which is roughly the central point of the central rigid planar piece 100 in the central group CG and the central point of said latch box 200, as shown in FIGS. 3A and 3B.

When said latch box 200 is kept at an upright position (i.e. vertical position) generally along the length-wise direction of the connected rigid planar piece 100, this is for said shield to be folded up and stored away. See FIG. 3A.

Figure 3B:
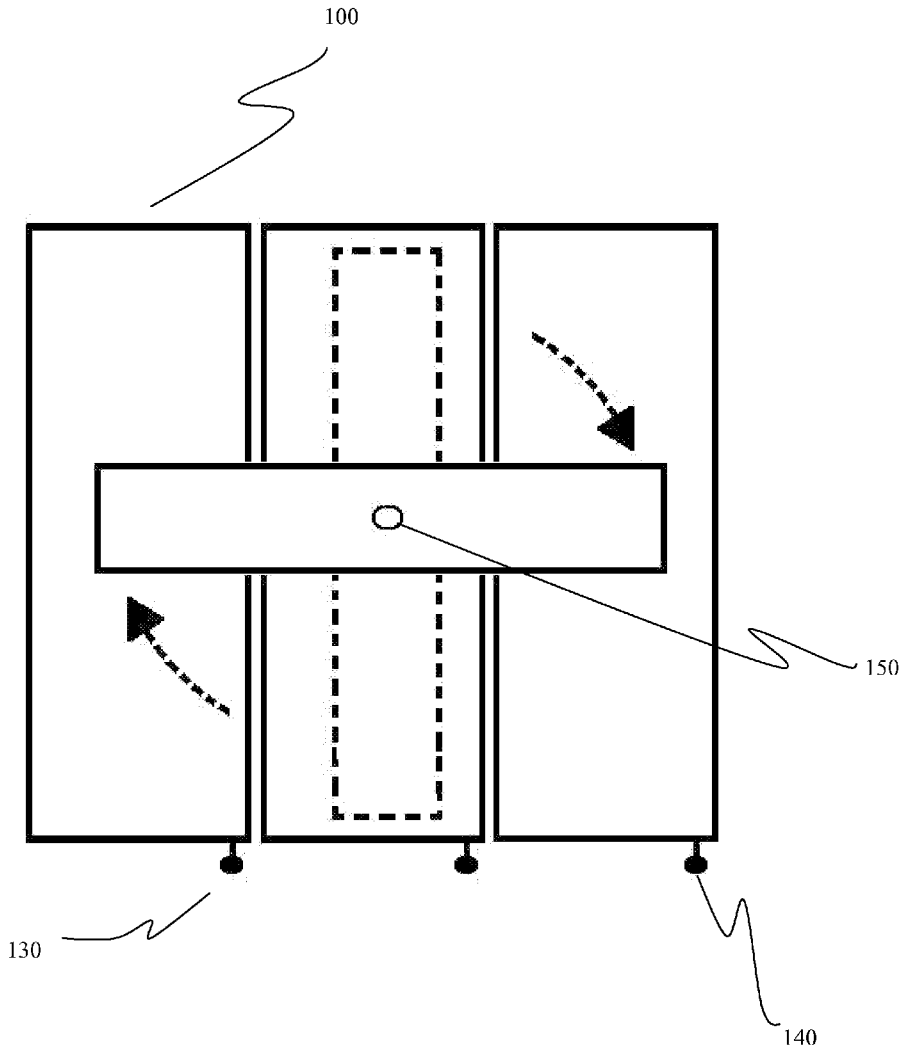
FIG. 3B shows the latch box pivoted to a horizontal deployed position.

Said latch box 200 will take up a 2-D area that is smaller than the central rigid planar piece 100, so that when it is pivoted to turn 90-degrees, it will form a horizontal "latch" across the surface area of three (3) rigid planar pieces 100, as shown in FIG. 3B.

Figure 4:
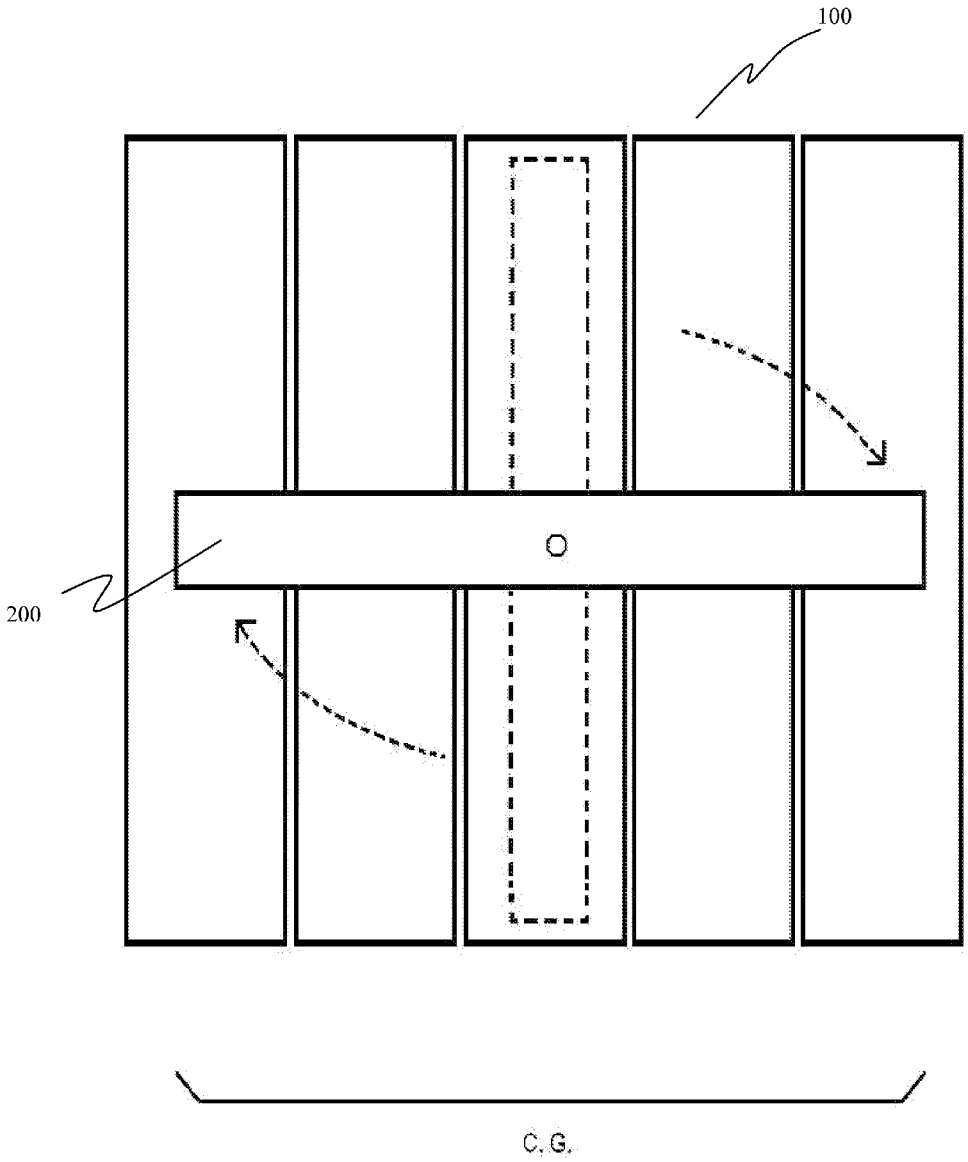
FIG. 4 shows a latch box connected to a central group with 5 rigid planar pieces.

As can be easily adapted by person reasonably skilled in the art, if the central group CG consists of 4, 5 or more rigid planar pieces 100, the same principle can apply to the 90-degree turn of the latch box 200 to generally form a horizontal "latch". See FIG. 4 for sample 5-piece central group (CG) construction.

Figure 5D:
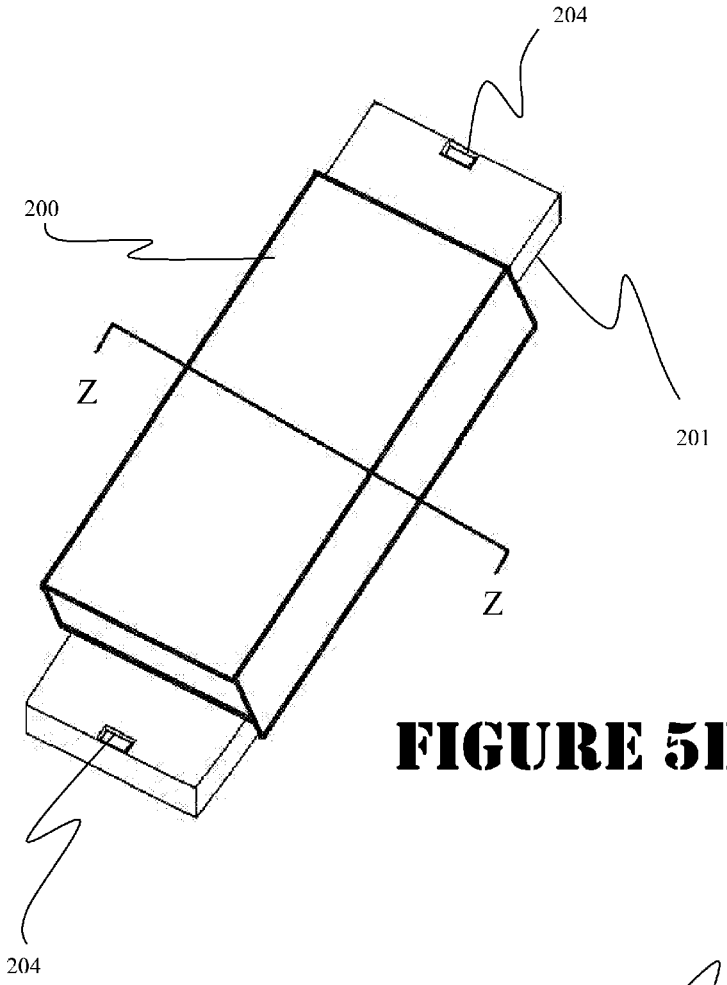
FIG. 5D shows the two inner bow pieces partially drawn out, with Z-Z cut line denoted.
Figure 5A:
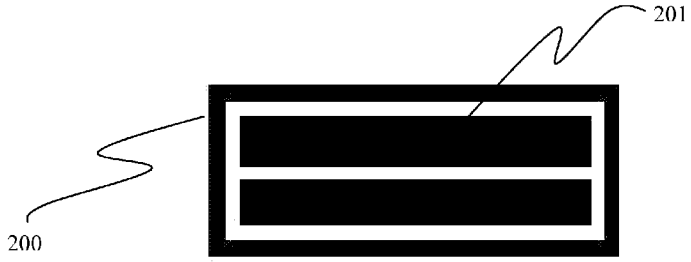
FIG. 5A shows the cross-sectional view taken through line Z-Z of FIG. 5D of a latch box containing two inner bow pieces.
Figure 5B:
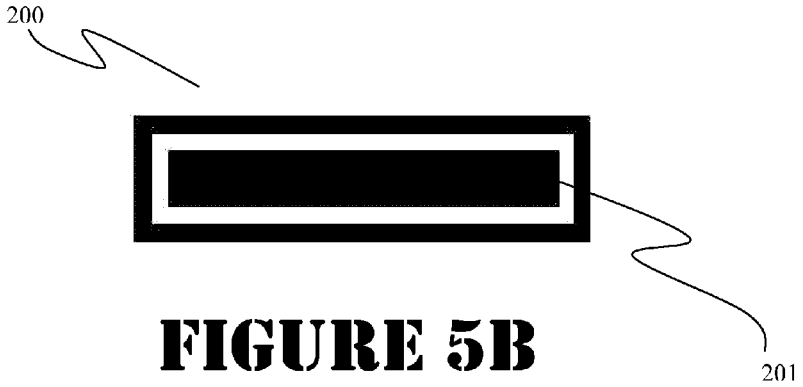
FIG. 5B shows the Z-Z line view of a latch box containing one inner bow piece.
Figure 5C:
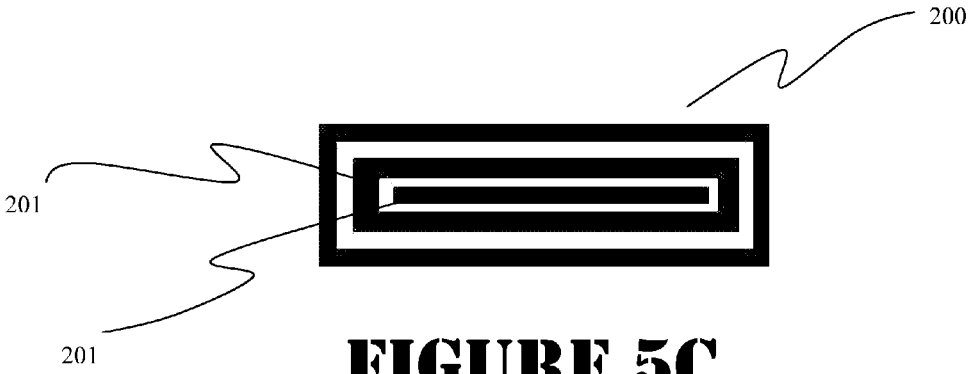
FIG. 5C shows the Z-Z line view of a latch box where the two inner bow pieces may be in a sword-sheath type of wrapping arrangement.

Said latch box 200 may further contain one or two inner bow pieces 201, as shown in FIGS. 5A-5D. Depending on specific implementations, said two inner bow pieces 201 may be in a sword-sheath type wrap-around arrangement, yet can be drawn out from the inside of said latch box 200 towards opposite directions, as shown in FIG. 5C.

Said inner bow piece 201 may contain a tab or other handle 204, allowing for easy human grasping to draw out from said latch box 200.

A preferred embodiment is for said latch box 200 to contain two inner bow pieces 201, so that when one inner bow piece 201 is drawn out from one end of said latch box 200, to form a horizontal bendable bow-like tensioning structure across the area of RG (or the LG), the other inner bow piece 201 will be synchronously drawn out from the other end of said latch box 200, due to a synchronizing mechanism 220 built inside said latch box 200.

The drawn out portion of said inner bow pieces 201 will provide the tensioning force to the connected rigid planar pieces 100 of either RG or LG, in addition to forming an overall bow tensioning force combining the latch box 200 and the drawn out inner bow pieces 201.

The combination of the latch box 200 with the drawing out inner bow pieces 201 forms a bendable bow-structure to prop the serially connected rigid planar pieces 100, where the left-most and right-most pieces 100 are engaged/connected to fixed structures, such as two flanking walls in a typical 90-degree formation, allowing the creation of a "pie" safety area surrounded by a protective surface (a protective shield), in a matter of seconds, As can be easily adapted by person reasonably skilled in the art, if the left group LG or right group RG consists of two or more rigid planar pieces 100, the same principle can apply to the extend the inner bow piece 201 being drawn out to form a bow-like tensioning structure across the surface of the more-than-two rigid planar pieces 100 on either right group RG or left group LG.

Additionally, at least one hooking device 180 is formed on each of the right-most side and left-most side of said connected rigid planar pieces 100, to allow hooking or engaging to corresponding hooking mechanisms on a wall or other similar structure.

Depending on the specific implementation need, each of said rigid planar piece 100 located on the right-most or left most side of said shield, may have 2 or more hooking devices 180, for engaging to corresponding structure on a wall.

As such, at deployed state, said shielding device 10 can be deployed near a corner of a room, forming a "pie" area, when it is "hooked" or "engaged" to two walls (having corresponding engagement structure) on the left and right sides of said connected rigid planar pieces 100.

Inside said latch box 200, a first preferred embodiment of a synchronizing mechanism 220 is shown, where inner gear mechanisms 235 are engaged to 2 inner bow pieces 201 and will result in the 2 inner bow pieces 220 to move synchronously in opposite directions.

Figure 7A:
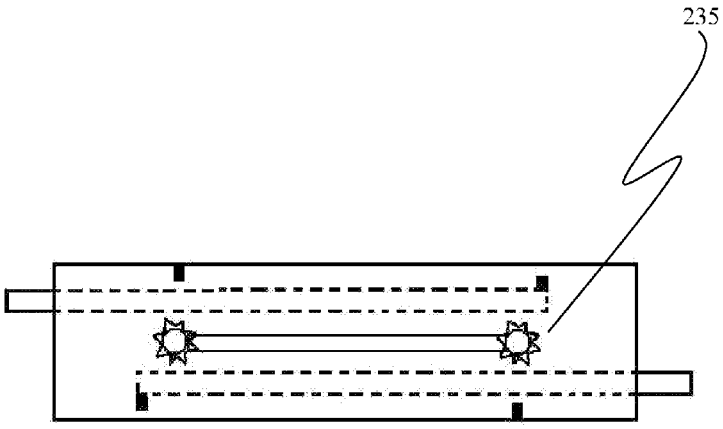
FIGS. 7A and 7B show the latch box's gear mechanism to allow synchronous opposite movements of inner bow pieces.
Figure 7B:
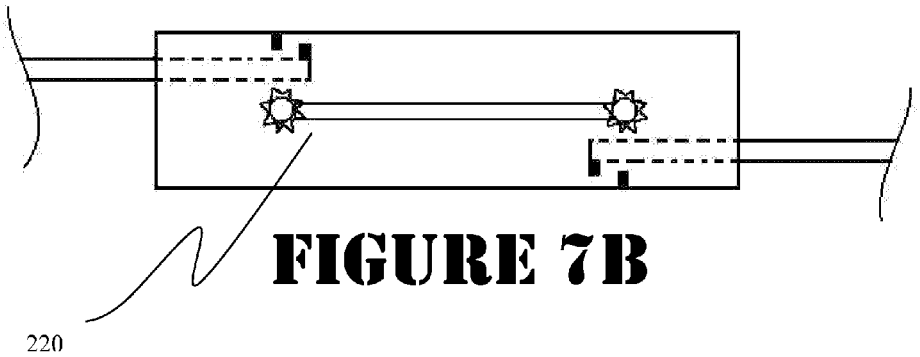

In actual implementation, said inner gear mechanisms 235 may be a set of 2 or 3 gears that are somewhat evenly spaced to engage over a broader cross area on the surface of said inner bow pieces 201. Reference FIGS. 7A and 7B.

As yet another embodiment of the shielding device 10 of present application, even-numbered rigid planar pieces 100 can also practice the same invention, except there is no exact central rigid planar piece 100 to fix said latch box 200. However, as long as said latch box 200 is fixed to a rigid planar piece 100 that is near the horizontal center location of a central group CG, allowing the 90-degree pivoting turn for the latch box 200 to form a horizontal latch across the general surface area, this is still within the meaning of the disclosure.

A simplified embodiment of the shielding device 10 may also be done using only 2 groups. For ease of discussion, the left group LG reference in earlier discussion is removed, leaving only right group RG for illustration herein. Certainly, the CG-RG implementation can be done to a central group CG with a left group LG (CG-LG) in the same and mirroring manner.

For the CG-RG construction depicted herein, a latch box 200 may contain only one inner bow piece 201 to be drawn out. Said latch box 200 is connected to a rigid planar piece 100 of said central group CG and pivot on the central pivoting point 150, providing a horizontal bow-tensioning force when said shielding device 10 is deployed and said latch box 200 is turned from its upright stored position to a horizontal deployment position. A single inner bow piece 201 can be drawn out to form the horizontal bow-like tensioning structure across the surface of rigid planar pieces 100 of right group RG.

Figure 8A:
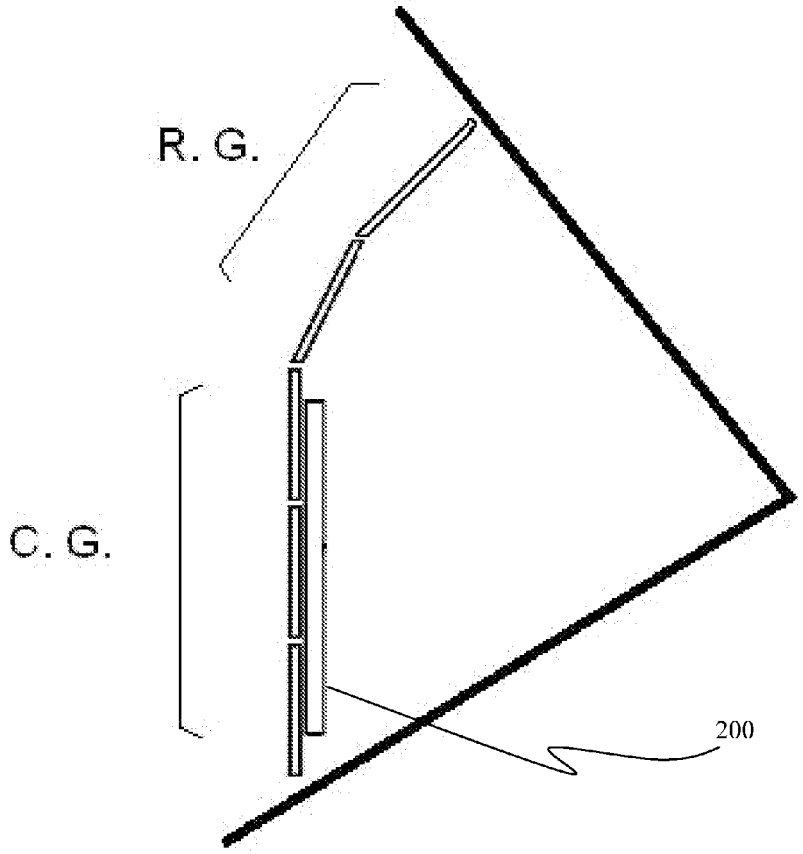
FIGS. 8A and 8B show the 2-group (CG-RG) construction.
Figure 8B:
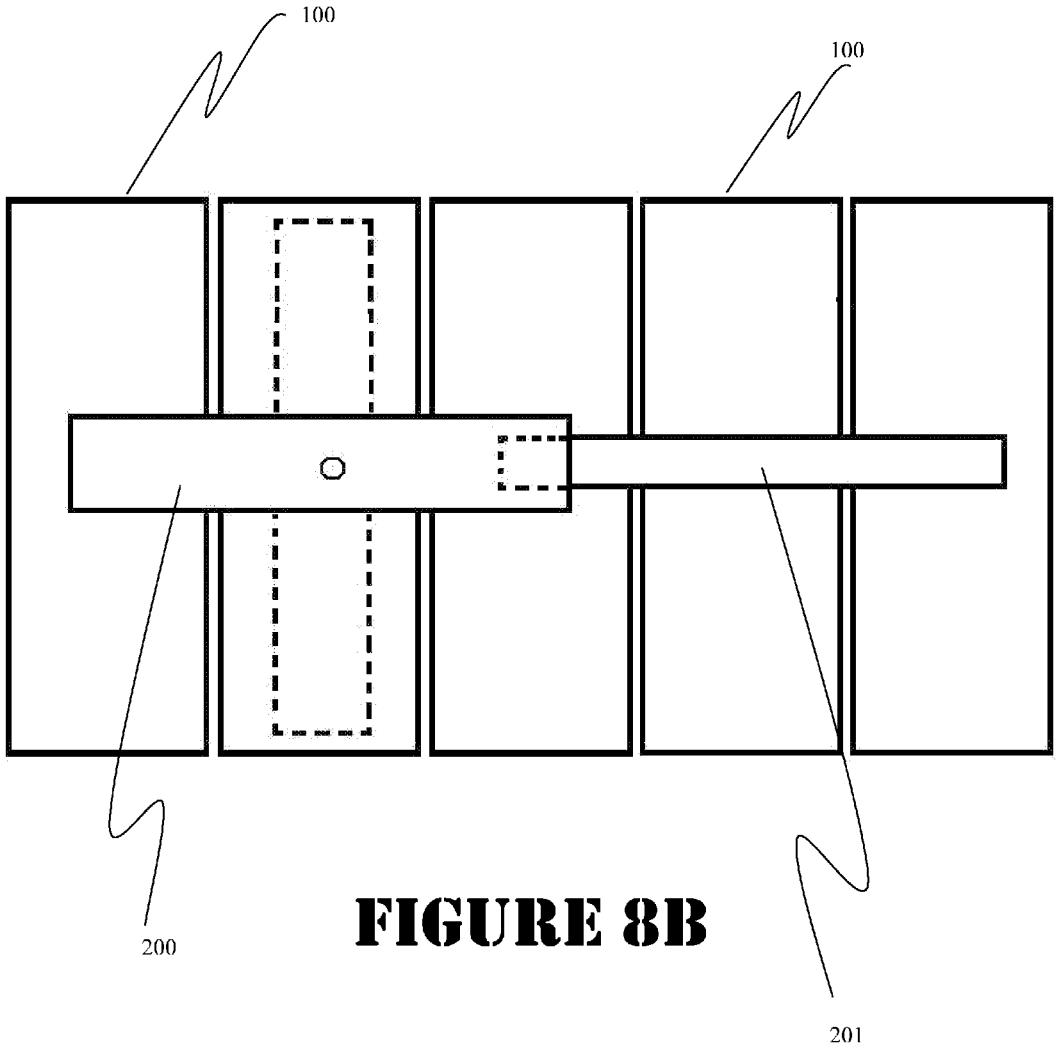

See FIGS. 8A and 8B for the 2-group CG-RG construction views.

In both the 3-group construction and the 2-group construction, the drawn out inner bow piece(s) 201 may have some overlapping tail end that remains inside said latch box 200, to provide for a bow-like tensioning structure combing the latch box 200 and said inner bow piece(s) 201, instead of a hinge-like connection.

Viewing the shielding device 10 at its deployed state, the bottom portion of said rigid planar pieces have foot pieces 130 that may contain detachable wheels 140. Said wheels 140 may be implemented by commercially available caster wheels that exist on normal office chairs. The wheels 140 will facilitate the moving and deployment of said shielding device 10. The wheels 140 may be removed, as appropriate, if a more stationary deployment relative to the ground surface is desired at time of usage.

In an alternative implementation, a shielding device 10 may contain only a single group of connected rigid planar pieces 100 wherein a latch box is connected to a central rigid planar piece 100 and said latch box 200 comprises of no inner bow piece 201. As such, a resistant screen may be formed by connecting 2 or more of this alternative shields 10, end to end.

Figure 9:
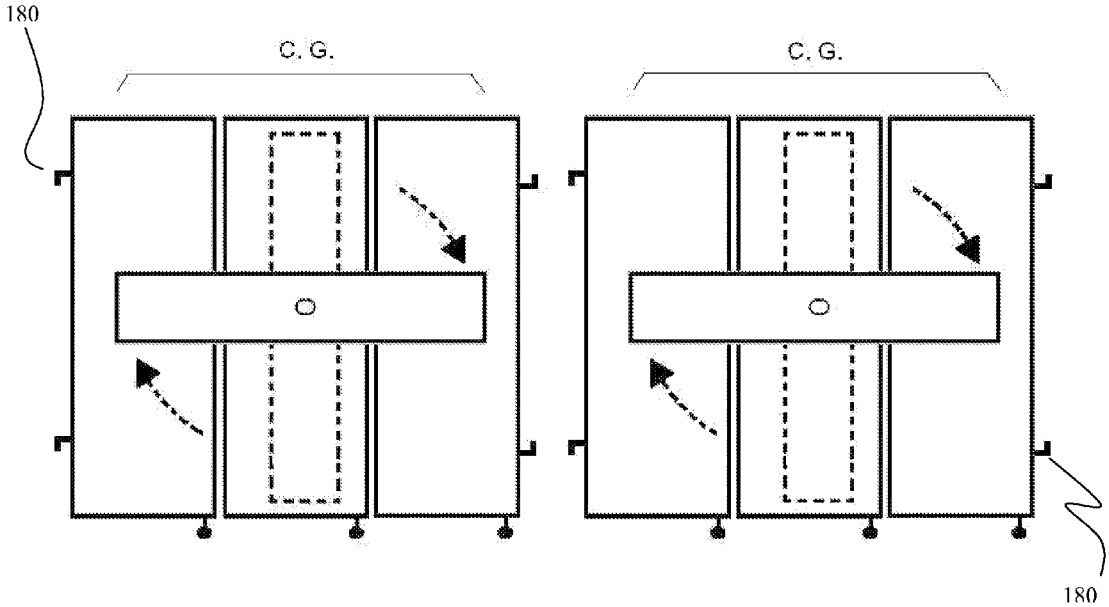
FIG. 9 shows two modules of 3-piece modular construction, having hooking devices on the right and left sides.

FIG. 9 shows 2 of said alternative 3-piece modular shielding device 10.

Figure 10:
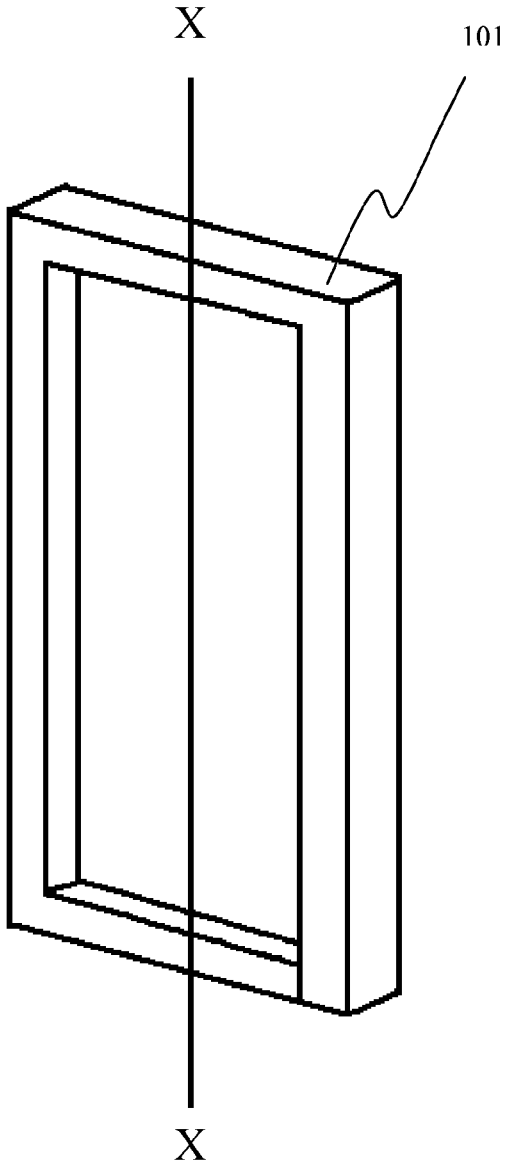
FIG. 10 shows the planar piece using the "rigid frame" construction. The X-X cut line denotes the views presented in FIGS. 11A/B/C/D.

As an alternative way of implementing shielding function of present invention, the rigid planar pieces 100 may be formed by a rigid frame 101 conforming to the desired outside shape of said rigid planar piece 100, as shown in FIG. 10.

For the center "cavity" area, suitable fabric-like materials 109 that has the desired flexible yet sturdy attribute can be cut and fixed to said rigid frame 101, achieving the creation of a planar piece with "screen" type surface.

The optional use of the sturdy fabric-like material, one or more layers, to create rigid planar piece has the advantages of reducing overall weight and also increasing the impact resistance from projectiles/bullets, due to the inherent "wiggle" nature.

Figure 11:
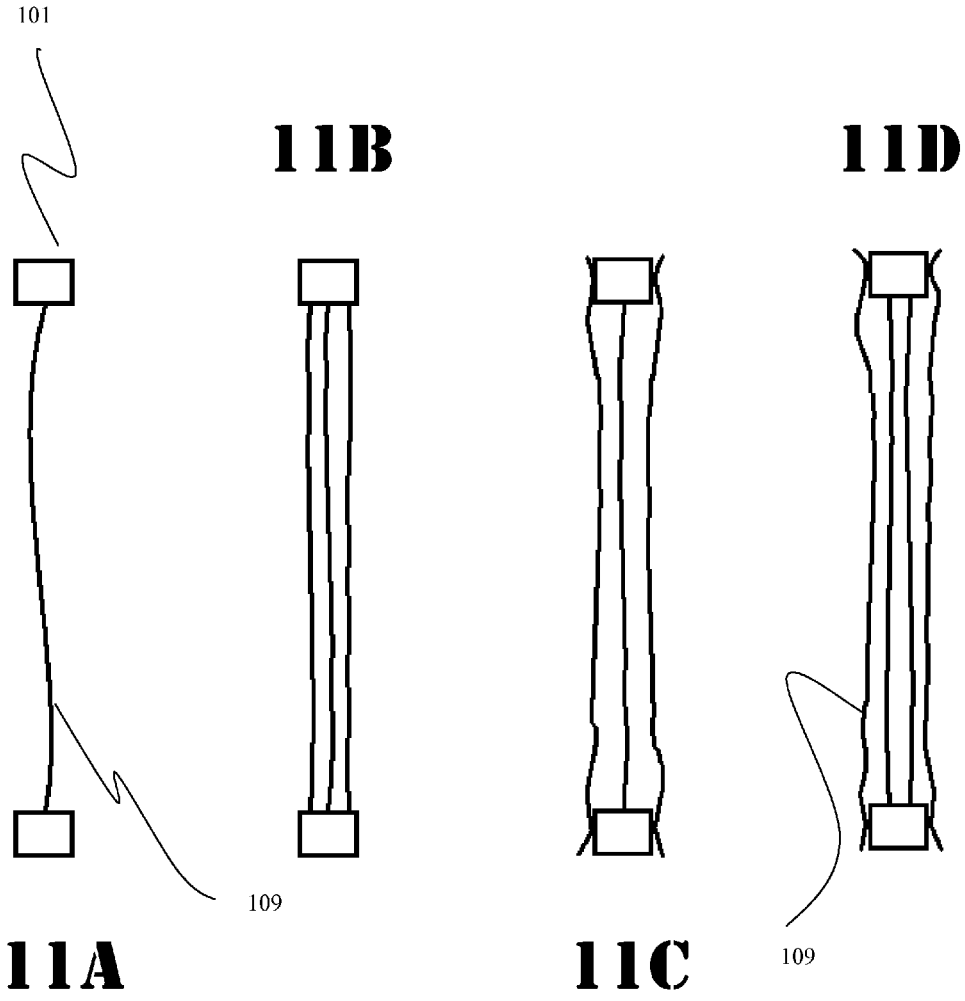
FIGS. 11A-11D show the use of sturdy flexible fabric-like material being affixed to the rigid frame, viewed from the X-X cut line of FIG. 10. Depending on the materials used, the fabric-like materials can be a single layer, two or more layers.

One or more layers of said sturdy flexible fabric-like material 109 can be fixed to said frame 101, as shown in FIGS. 11A/B/C/D.

Figure 6:
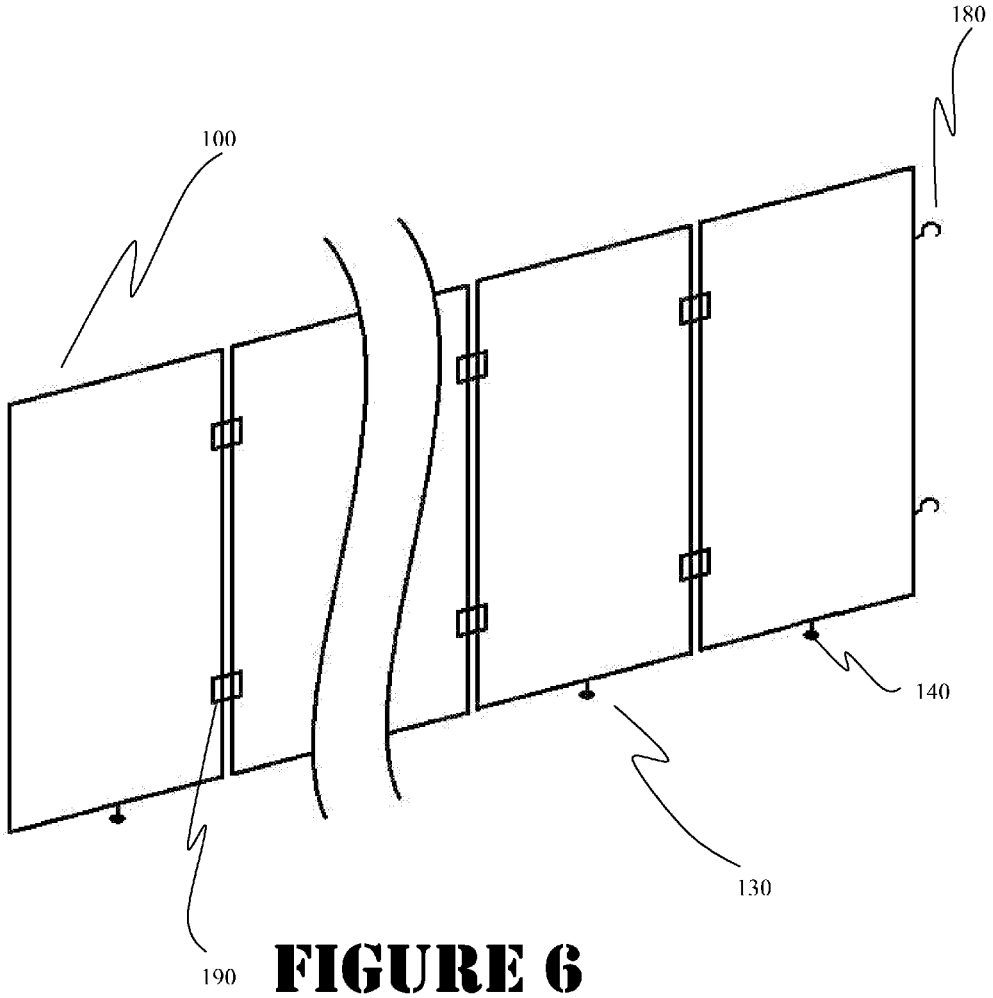
FIG. 6 shows hooking device(s) on the side of the shield, foot piece and detachable wheels.
Figure 12A:
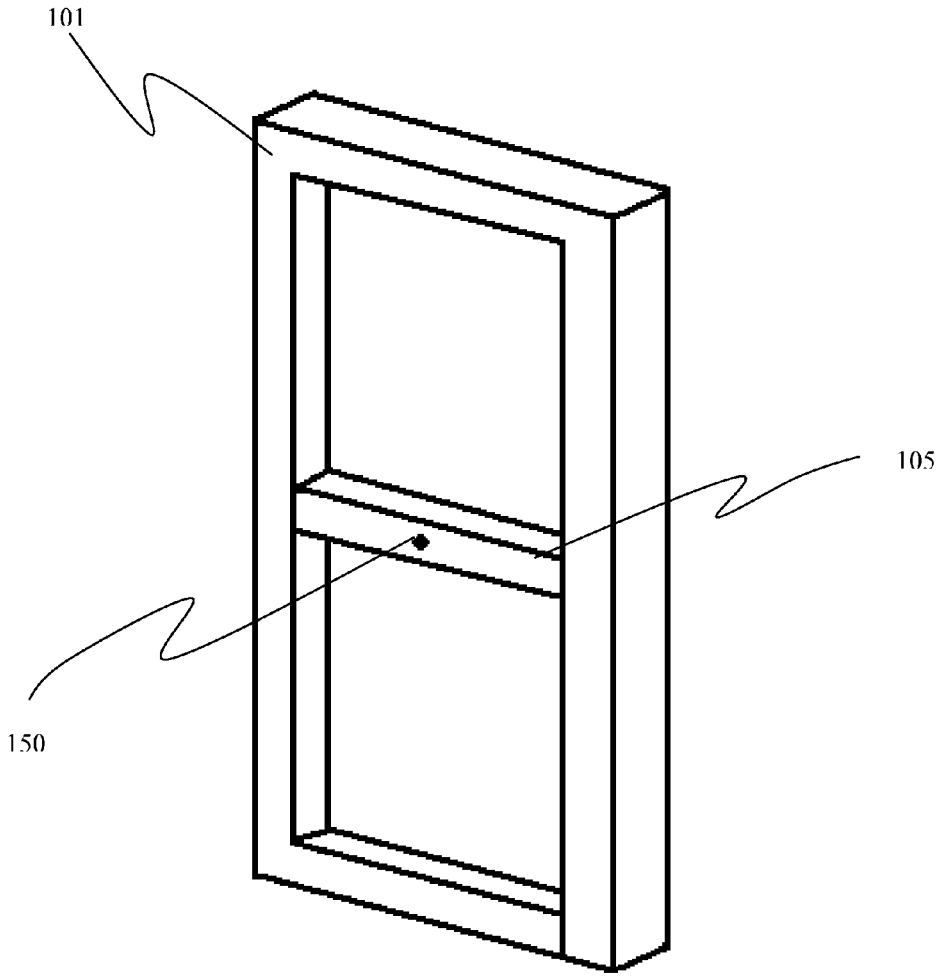
FIG. 12A show a rigid frame with a frame center row, to provide a central pivoting point for supporting a latch box.
Figure 12B:
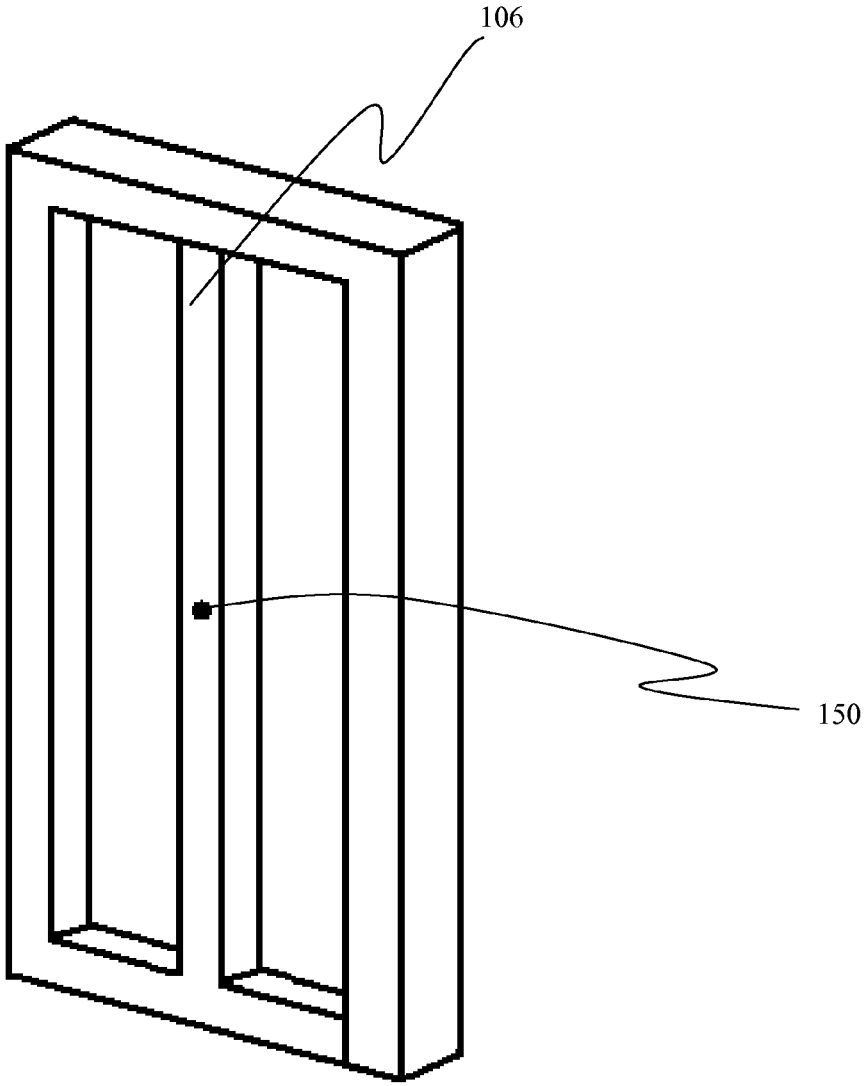
FIG. 12B shows a rigid frame with a frame center column, to provide a central pivoting point for supporting a latch box.

To provide for the structural support for said latch box 200, a rigid frame 101 may have a frame center row 105, so that said latch box 200 may form the needed pivoting point 150 upon said frame center row 105. Alternatively, a rigid frame 101 may have a frame center column 106 to provide the pivoting point 150 for said latch box 200. See FIGS. 12A and 12B. Note the orientation of the row/column is based upon the way FIGS. 12 A/B are shown; and is the same as the orientation shown in FIGS. 6 and 9.

What is claimed is:

1. A shielding device, comprising:

a. a plurality of rigid planar pieces serially connected together;

b. a latch box pivotably connected to one central rigid planar piece at the central point of said latch box and at the central point of said central rigid planar piece; and, c. said latch box further having at least one slidable inner bow piece that can be drawn out from the inside space of said latch box to extend out, to form a horizontal bendable bow-like tensioning structure for support of said rigid planar pieces when said latch box is pivoted to a horizontal orientation.

2. The shielding device of claim 1, wherein said latch box contains two slidable inner bow pieces that can be drawn outwardly away from the latch box in opposite directions and in a synchronous manner.

3. The shielding device of claim 2 further comprising hooking devices on the left-most and right-most rigid planar pieces.

4. The shielding device of claim 3, wherein each of said two slidable inner bow pieces will have a small section of its full length remaining inside said latch box when drawn out, so as to provide a bow-like tensioning structure combining the drawn out pieces and the latch box.

5. The shielding device of claim 3 wherein the connection between any two rigid planar pieces is by hinges.

6. The shielding device of claim 3 further comprising foot pieces that have detachable wheels, so as to facilitate moving around on the ground either in the fold-up state or deployed state.

7. The shielding device of claim 1, wherein said rigid planar piece may be formed by a rigid frame with a layer of sturdy flexible fabric-like material fixed to said rigid frame.

8. The shielding device of claim 1, wherein said rigid planar piece may be formed by a rigid frame with two or more layers of sturdy flexible fabric-like material fixed to said rigid frame.

9. The shielding device of claim 1, wherein said rigid planar may further contain a frame center row, so as to provide a pivotal point to support said latch box.

10. The shielding device of claim 1, wherein said rigid planar piece may further contain a frame center column, so as to provide a pivotal point to support said latch box.

11. A shielding device, comprising:

a. a plurality of rigid planar pieces serially connected together;

b. a latch box pivotably connected to the a rigid planar piece that is near the center location of said connected rigid planar pieces, and at the central point of said latch box;

c. said latch box further having two slidable bow pieces that can be drawn from the inside space of said latch box to extend out, to form a horizontal bendable bow-like tensioning structure for said rigid planar pieces when said latch box is pivoted to a horizontal orientation; and, d. at least a hooking device on each of the left-most and right-most rigid planar pieces, so as to allow easy connecting to external structures.

12. The shielding device of claim 11, wherein said two slidable inner bow pieces move outwardly away from the latch box in a synchronous manner when drawn out.

13. The shielding device of claim 11, wherein each of said two slidable inner bow pieces will have a small section of its full length remaining inside said latch box when drawn out, so as to provide a bow-like tensioning structure combining the drawn out pieces and the latch box.

14. The shielding device of claim 11, further comprising foot pieces on said rigid planar pieces that have detachable wheels, so as to facilitate moving around on the ground either in the fold-up state or deployed state.

15. The shielding device of claim 11, wherein said rigid planar piece may be formed by a rigid frame with a layer of sturdy flexible fabric-like material fixed to said rigid frame.

16. The shield device of claim 11, wherein said rigid planar piece may be formed by a rigid frame with two or more layers of sturdy flexible fabric-like material fixed to said rigid frame.

17. The shielding device of claim 11, wherein said rigid planar may further contain a frame center row, so as to provide a pivotal point to support said latch box.

18. The shielding device of claim 11, wherein said rigid planar piece may further contain a frame center column, so as to provide a pivotal point to support said latch box.

19. A shielding device, comprising:

a. a plurality of rigid planar pieces serially connected together;

b. a latch box pivotably connected to a rigid planar piece, wherein said each of said latch box contains at least one inner slidable bow piece that can be drawn out from the inside space, to form a horizontal bendable bow-like tensioning structure, when said latch box is pivoted to a horizontal orientation; and, c. at least one hooking device on each of the left-most and right-most end of the overall connected rigid planar pieces, so as to allow easy connecting to external structures.

20. The shielding device of claim 19, wherein said rigid planar piece may be formed by a rigid frame with a layer of sturdy flexible fabric-like material fixed to said rigid frame.

21. The shielding device of claim 19, wherein said rigid planar piece may be formed by a rigid frame with two or more layers of sturdy flexible fabric-like material fixed to said rigid frame.

22. The shielding device of claim 19, wherein said rigid planar may further contain a frame center row, so as to provide a pivotal point to support said latch box.

23. The shielding device of claim 19, wherein said rigid planar piece may further contain a frame center column, so as to provide a pivotal point to support said latch box.

24. A shielding device, comprising:

a. a plurality of rigid planar pieces serially connected together;

b. a latch box pivotably connected to a centrally located planar rigid piece, to form a horizontal bow-like tensioning structure, when said latch box is pivoted to a horizontal orientation; and, c. at least one hooking device on each of the left-most and right-most end of the overall connected rigid planar pieces, so as to allow easy connecting to external structures or other corresponding hooking devices on similar shield.

25. The shielding device of claim 24, wherein said rigid planar piece may be formed by a rigid frame with a layer of sturdy flexible fabric-like material fixed to said rigid frame.

26. The shielding device of claim 24, wherein said rigid planar piece may be formed by a rigid frame with two or more layers of sturdy flexible fabric-like material fixed to said rigid frame.

27. The shielding device of claim 24, wherein said rigid planar may further contain a frame center row, so as to provide a pivotal point to support said latch box.

28. The shielding device of claim 24, wherein said rigid planar piece may further contain a frame center column, so as to provide a pivotal point to support said latch box.

* * * * *